United States Patent [19]

Benwood et al.

[11] 4,228,480

[45] Oct. 14, 1980

[54] ELECTROPHOTOGRAPHIC APPARATUS WITH IMPROVED CORONA CHARGING

[75] Inventors: Bruce R. Benwood, Spencerport; Paul A. LaChapelle, Fairport, both of N.Y.

[73] Assignee: Eastman Kodak Company, Rochester, N.Y.

[21] Appl. No.: 11,606

[22] Filed: Feb. 12, 1979

[51] Int. Cl.[3] ..... H01T 19/04

[52] U.S. Cl. ..... 361/235; 250/326

[58] Field of Search ..... 361/225, 229, 230, 235; 250/324, 325, 326

[56] References Cited

U.S. PATENT DOCUMENTS

| | | | |
|---|---|---|---|
| 2,868,989 | 1/1959 | Haacke . | |
| 3,076,092 | 1/1963 | Mott . | |
| 3,133,193 | 5/1964 | Guillotte et al. . | |
| 3,275,837 | 9/1966 | Codichini et al. . | |
| 3,335,273 | 8/1967 | Walkup . | |
| 3,335,274 | 8/1967 | Codichini et al. . | |
| 3,335,275 | 8/1967 | King . | |
| 3,492,476 | 1/1970 | Germanos . | |
| 3,527,941 | 9/1970 | Culhane et al. | 361/235 X |
| 3,649,830 | 3/1972 | Sato et al. . | |
| 3,819,942 | 6/1974 | Hastwell et al. | 250/324 |
| 3,912,989 | 10/1975 | Watanabe et al. | 361/235 X |
| 3,934,141 | 1/1976 | Vargas, Jr. | 250/325 |
| 3,942,080 | 3/1976 | Milewski . | |
| 3,961,193 | 6/1976 | Hudson | 361/235 X |
| 3,991,311 | 11/1976 | Plumadore | 250/326 |

*Primary Examiner*—Harry E. Moose, Jr.
*Attorney, Agent, or Firm*—John D. Husser

[57] ABSTRACT

In-place primary charging of an electrophotographic imaging member is effected by a corona discharge device which employs variably-biased AC energization of its discharge electrode. During a charging period the potential level of the image member is detected by a sensor, and the bias level of electrode energizing source is varied from an initial value above the nominal primary charge potential toward the nominal potential in response to signals from the sensor.

10 Claims, 4 Drawing Figures

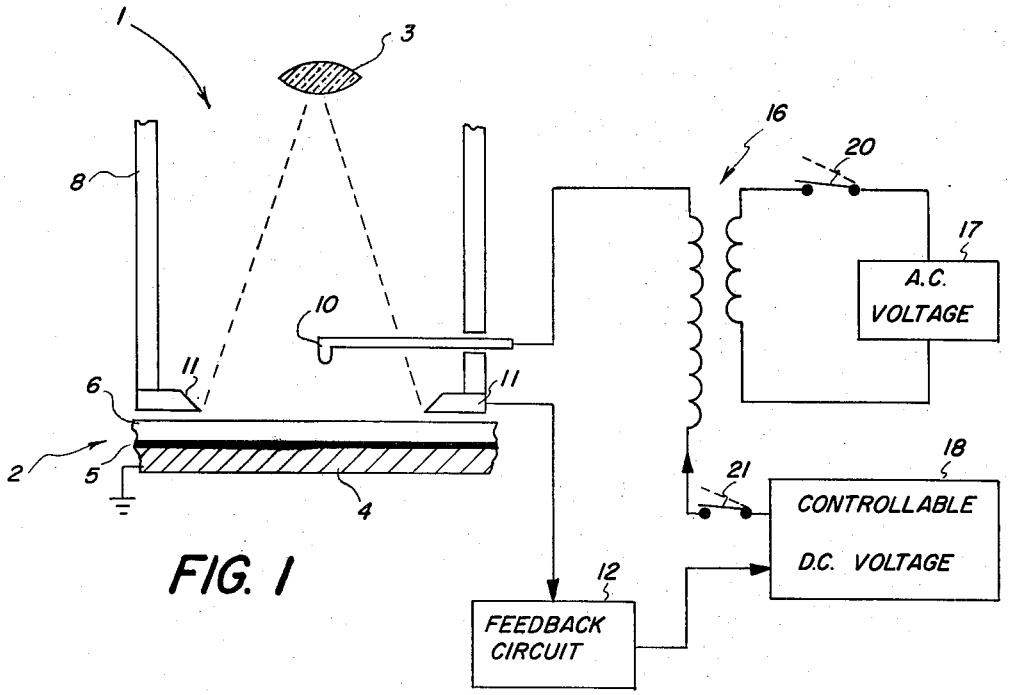
FIG. 1
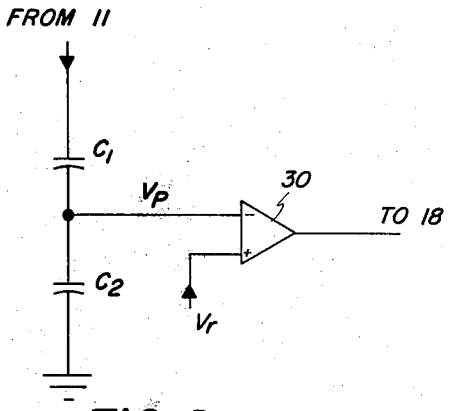
FIG. 2
FIG. 3
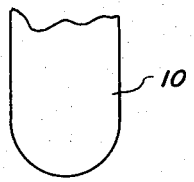
FIG. 4
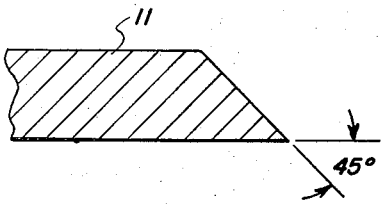

ELECTROPHOTOGRAPHIC APPARATUS WITH IMPROVED CORONA CHARGING

BACKGROUND OF THE INVENTION

1. Field of Invention

The present invention relates to electrophotographic apparatus and more particularly to improved corona charging structure for in-place primary charging of the photoconductive image member.

2. Description of Prior Art

In electrophotographic imaging an overall primary electrostatic charge is applied to the photoconductive imaging member prior to its imagewise exposure. This primary charge should be uniform at different loci within a given imaging area (i.e., have intra-image charge uniformity) in order to achieve uniformity of tone in the final electrographic image, after exposure and development. Also, the level of the primary charge should be consistent for successive image areas because inter-image variations from a nominal level create overall image inconsistencies, e.g., images which are too light or too dark throughout their respective image area.

The uniformity and consistency of primary charge also is important to other aspects of electrophotographic imaging; and there has been continual effort directed toward the development of corona charging devices which will reliably provide such a primary charge. Optimal charging devices would achieve such primary charge regardless of environmental variations, such as humidity and barometric pressure changes that affect the rate of ion generation and transport, and regardless of variation in the current energizing the corona discharge device, variation caused by aging or uncleanness of the corona electrodes, etc. Also, it is often desirable for such charging devices to reach the nominal primary charge level rapidly, for charging time can be the limiting parameter for the copy speed of the entire electrophotographic machine.

Grid-controlled charging devices (in which a grid located between the corona discharge electrode and the photoconductor is DC-biased to the surface potential desired for the photoconductor) have been very successful in achieving adequate primary charging in certain applications, e.g. where the photoconductor is moving past the charger during charging. However, in an in-place charging mode (where the photoconductor is stationary relative to the charger), the grid controlled charger is relatively slow. Also, in applications, e.g. where it is advantageous to charge and expose the photoconductor at the same location, the control grid presents optical problems.

For in-place charging of photoconductors it has been found advantageous to use DC-biased AC charging devices of the kind in which the level of DC biasing establishes an equilibrium potential for charging of the photoconductor surface (see e.g. U.S. Pat. Nos. 3,076,092 and 3,942,080). More specifically, in AC charging devices the net charge migration that occurs during an AC energization cycle constitutes the charge applied to the photoconductor surface during the cycle. By DC-biasing the AC energizing source to a predetermined positive or negative potential level, a preponderance positive or negative charge can be caused to migrate to the surface until the surface potential is sufficiently equal to the bias potential to create an equilibrium condition. Although these prior art devices provide a useful degree of control on the final charge level of the photoconductor, they remain sensitive to the environmental and other system variations noted above. Like the grid controlled charging devices they are relatively slow in attaining the final equilibrium charge.

SUMMARY OF INVENTION

The present invention pertains to improved structure and techniques for implementing in-place primary charging in electrophotographic apparatus. In one aspect the present invention provides improvements in such charging systems which render them significantly less susceptible to process parameters variations of the type mentioned above. In another aspect the present invention provides improvements in such charging systems by decreasing the period in which the nominal primary charge can be attained. In another aspect the present invention provides improvements in such charging systems by providing increased uniformity of intra-image charge.

It is therefore an object of the present invention to provide improved apparatus and modes for rapidly and consistently charging photoconductive imaging surfaces, in-place, to a nominal potential level, with a high degree of intra-image uniformity.

The above and other objects and advantages are accomplished according to one embodiment of the present invention by providing, in electrophotographic apparatus, a corona discharge electrode, energizing means including a source of variably biasable AC potential coupled to said electrode and electrode and control means for varying the bias of said energizing means from a potential level substantially in excess of the nominal primary charge potential for the photoconductor to an equilibrium potential for the nominal primary charge potential. In one preferred embodiment the control means includes means for sensing the potential level of the photoconductor surface during such charging and for regulating the bias in accordance with that sensed level.

BRIEF DESCRIPTION OF DRAWINGS

In the subsequent detailed description of preferred embodiments of the invention, reference is made to the attached drawings which form a part hereof and in which:

FIG. 1 is a schematic and block diagram illustration of a charging station according to one embodiment of the present invention;

FIG. 2 is a schematic diagram of the feedback circuit in FIG. 1;

FIG. 3 is a greatly enlarged side view of the end of a preferred corona discharge electrode tip configuration; and FIG. 4 is a greatly enlarged sectional view of the mask-sensor structure shown in FIG. 1.

DETAILED DESCRIPTION OF PREFERRED EMBODIMENTS

FIG. 1 illustrates a charging station 1 of a type in which the present invention can be advantageously utilized. As shown this is operable also as an image exposing station so that an imaging member 2 can be exposed to an image radiation pattern, by means of projection lens 3, without movement from the charging position.

In the charging station 1, a support platen 4, which can be electrically conductive and grounded, is located and configured to support imaging member 2 in a charging and exposure plane. The electrically conductive backing 5, which underlies photoconductive insulator layer 6 of image member, is in contact with platen 4 and therefore grounded. It will be appreciated that in other embodiments the image member 2 may have a film support under conductive layer 5 and in those instances grounding can be implemented by other known techniques, e.g. via a bare edge strip of the layer 5.

Enclosing the charging-exposure station is a wall 8 which can be electrically insulative and light-tight. Corona discharge electrode 10 extends through the wall 8 and its needle tip extends to a central location above the platen 4. The electrode can be formed, e.g., of a 0.006 inch tungsten wire. It is noted that the electrode 10, in this configuration, can be sufficiently spaced (e.g., about 0.250 inches) from the focal plane of lens 3 to avoid any detrimental effect on imaging. Located around the edge of the image area of the photoconductor surface is a conductive member 11 which is electrically connected to a feedback circuit 12 and which functions as an edge mask for the image area and as an electrical sensor, the latter feature being described in more detail subsequently. It is to be noted that wall 8 can be formed of conductive material; however, in that instance, electrode 10 and member 11 should be electrically isolated from the housing by insulators or spacers.

The corona discharge electrode 10 is coupled to the secondary winding of a transformer 16 which steps-up line AC-voltage from source 17 that is coupled to its primary winding. Also coupled to transformer 16 is a source of DC voltage 18 which is of a type that can provide outputs of different potential level in response to appropriate input control signals. Thus, source 18 provides a controllable DC bias to the AC voltage, which can vary in potential level according to signals received from a feedback circuit 12.

Before describing the details of one preferred feedback circuit, the general procedure of a charging operation will be described. Thus, after the advance of a given image area of member 2 into the location shown in FIG. 1, appropriate machine logic (not shown) actuates initiation of a charging period, e.g. by closing switches 20 and 21. Alternating current, e.g., 60 Hz, 110 volts, is applied to the primary transformer 16 and from secondary of that transformer a high voltage, e.g., in the range of 3000 to 8000 volts, is supplied to corona discharge electrode 10. This high AC voltage exceeds the threshold of corona emission creating ions and electrons near the tip of the electrode. However, in the absence of any DC bias the net migration of ions to the photoconductor surface would not be of useful magnitude. The superposing of a DC bias (positive or negative) on the AC voltage creates an imbalance in the cyclic electrical fields which favors deposition of charge of one polarity (the same as the polarity of the DC bias). This imbalance continues until equilibrium conditions exist, i.e., the potential of the photoconductor surface is at a level that is proportional to the DC bias potential. At that time the photoconductor is again charged and discharged in approximately equal amounts in successive half cycles. Charging is then complete and exposure can be effected.

Another aspect of this phenomenon is significant. With a DC bias, the photoconductor's net charging rate at various times during the charging cycle will be proportional to the extent of field imbalance which exists between the photoconductor and the discharge electrode at that particular time. Stated another way, assuming a bias of −600 volts, the photoconductor will obtain negative charge faster when its surface potential is 0 volts than when the surface potential has risen to −500 volts. Thus as the surface potential nears the bias potential the charging rate slows until equilibrium is reached. The excellent accuracy with which such a DC-biased AC charging system can achieve a predetermined potential level on the photoconductor is desirable; however, the decrease in charging rate is often a disadvantage, as mentioned above.

Referring now to FIGS. 1 and 2, it will be seen how the present invention avoids such disadvantages and otherwise improves the charging process. As shown in FIG. 2, the conductive plate 11, which is supported proximate to the photoconductor surface, is coupled to a voltage divider system comprising capacitors $C_1$ and $C_2$. Together the elements provide an accurate means for sensing and signalling the potential level of the photoconductor surface. The capacitance values are selected so that charging time of the voltage divider system is approximately equal to the charging time of member 2, and the mask potential thus approximately equals the film potential at all times during a charging period. Since the mask is in close physical proximity to the film surface, its final equilibrium potential is virtually identical to that of the film.

The mask and voltage divider system therefore provides a signal Vp indicative of the instananeous potential on the photoconductor to one terminal of comparator 30, e.g. a conventional difference amplifier. A fixed reference signal Vr, indicative of the nominal potential level, is applied to the other terminal of comparator 30 which outputs a signal proportional to the difference between Vr and Vp. As shown in FIG. 1, the output of the comparator is coupled to the controllable DC voltage source 18 which, as described, is disposed to adjust the level of bias applied to the discharge electrode 10 in a direct proportion to the magnitude of the signal from comparator 30. Thus as charging commences the signal Vp is small and the signal from comparator accordingly signals a large bias for the discharge electrode. This allows more rapid charging of the photoconductor and as its surface potential approaches the nominal level, Vp approaches Vr. The comparator signal provides for decreases in the DC bias potential continuously until Vp approaches Vr and the photoconductor surface potential reaches the nominal potential at which stage equilibrium charging and discharging commences.

In one embodiment designed for obtaining a surface potential of −600 volts, the parameters of circuits 12 and 18 were chosen so that the initial DC bias voltage was −1100 volts which voltage was decreased to approximately −600 volts as the photoconductor surface charged. In about 0.5 to 0.7 seconds this device achieved a charge uniformity of the type previously obtainable only with much longer charging times of about 2.0 to 3.0 seconds. This charging device was highly insensitive to environmental changes such as humidity and barometric pressure variations. Control as described can be accomplished with both high and low frequency currents; however, high frequencies produce smaller voltage fluctuations on the photoconductor in the equilibrium condition.

It will be appreciated that the rate at which the bias is decreased in proportion to the increase of the photoconductor potential can be according to a program, e.g., to decrease the bias less with respect to initial surface potential increases than with respect to the later potential level increases occurring near equilibrium conditions. This is desirable to further enhance the rate of charging.

If desired, the sensing system could be eliminated and the bias voltage could be programmed directly. Although this approach retains the charge rate advantage of the above-disclosed system it would be more sensitive to variation in charging system parameters than the preferred embodiment described above.

It will be appreciated also that a net potential bias can be provided by means other than described above. For example, a variable resistance and diode could be provided in parallel between the AC source and the corona discharge electrode. In such an arrangement the value of the resistance unbalances the field during the half cycle when the diode is off. By varying the resistance in such a circuit in accordance with the signal from comparator 30 (i.e. decreasing the unbalancing resistance value as potential level rises) a similar bias control effect can be obtained.

It has been found that uniformity of potential level across the image area can be further enhanced by provision of a needle electrode having a rounded rather than sharp discharge tip. One method of forming such a tip is to melt the end of the electrode wire, e.g. a 0.006 inch tungsten wire, and form it into a hemisphere in the manner shown in FIG. 3.

Another variation for further enhancing rate and uniformity of charging according to the present invention is to utilize a square wave voltage for energization of the discharge electrode rather than a sinusoidal wave. This can be accomplished by using a square wave generator instead of a sinusoidal line voltage as the AC voltage source 17.

Another advantageous structural feature for minimizing center-to-edge decreases in charge level is shown in FIG. 4. It has been found that construction of the edge with a bevel, e.g. 45°, significantly improves the uniformity of edge and central portion potentials and does not deter the sensing function of mask 11.

The invention has been described in detail with particular reference to certain preferred embodiments thereof and it will be understood that variations and modifications can be effected within the spirit and scope of the invention.

What is claimed is:

1. In electrophotographic apparatus of the type having a charging station for applying a primary charge of nominal potential level to the imaging surface of a stationary photoconductor, an improved charging device comprising:

(a) corona discharge means for generating electrostatic charge when energized;

(b) energizing means including a source of variably-biasable AC potential coupled to said corona discharge means; and (c) control means for varying the bias of said energizing means, during a period of primary charging, from a level substantially above said nominal potential level toward said nominal potential level.

2. The invention defined in claim 1 wherein said control means includes means for sensing the potential level of such imaging surface during the period of charging and for decreasing the bias of said energizing means in response to increasing potential on such surface.

3. The invention defined in claim 2 wherein said sensing means includes a conductive plate located proximate an edge of such imaging surface.

4. The invention defined in claim 1 wherein said corona discharge means includes a conductive wire having a generally hemispherical tip located above the center of such imaging surface.

5. The invention defined in claim 1 wherein said energizing means includes means for producing a generally square wave AC voltage.

6. In electrophotographic apparatus of the type having a charging station whereon a stationary photoconductor is disposed for application of a primary charge, an improved charging device comprising:

(a) energizable corona discharge means, including a needle electrode spaced centrally from said station, for generating electrostatic charge;

(b) means, including a source of controllably-biasable AC potential, for energizing said corona discharge means; and (c) means for controlling the bias of said energizing means, during a period of primary charging, so as to vary such bias from a level substantially above said nominal potential level at the inception of said charging period to an equilibrium level for said nominal potential at the termination of said charging period.

7. The invention defined in claim 6 wherein said control means includes means for sensing the potential level of such imaging surface during said period and for decreasing the bias of said energizing means in predetermined proportion to the increase of potential on such surface.

8. Apparatus for rapid and accurate in-place charging of a photoconductor image area to a nominal electrostatic charge level, said apparatus comprising:

(a) a corona discharge electrode;

(b) means for supporting such photoconductor with such image area in charge receiving relation to said electrode;

(c) a source of AC voltage coupled to said electrode;

(d) a source of DC voltage coupled so as to bias the AC voltage applied to said electrode, the magnitude of said DC voltage being controllably variable within a range including said nominal potential and potential levels substantially above said nominal potential level;

(e) sensing means, including a member located proximate said charging station, for sensing potential levels of a photoconductor image area during charging by said corona discharge electrode and for providing a variable signal representative thereof;

(f) means for comparing said variable signal to a reference signal indicative of said nominal potential level; and (g) control means, coupled to said DC source and to said comparing means, for varying said DC voltage downwardly from a level substantially above said nominal potential as the difference between said varying signal and said reference signal decreases;

whereby said image area is rapidly electrostatically charged, uniformly, to said nominal potential level.

9. The invention defined in claim 8 wherein said member is electrically conductive and said sensing means includes a capacitive voltage divider circuit coupled to said member.

10. The invention defined in claim 9 wherein said capacitive circuit has a charging rate approximately equal to that of said photoconductor.

* * * * *